US007396141B2

(12) United States Patent
Chapman

(10) Patent No.: US 7,396,141 B2
(45) Date of Patent: Jul. 8, 2008

(54) LED PUSH ROD FLASHLIGHT

(75) Inventor: Leonard T. Chapman, North Hollywood, CA (US)

(73) Assignee: Chapman/Leonard Enterprises, Inc., North Hollywood, CA (US)

( * ) Notice: Subject to any disclaimer, the term of this patent is extended or adjusted under 35 U.S.C. 154(b) by 225 days.

(21) Appl. No.: 11/379,875

(22) Filed: Apr. 24, 2006

(65) Prior Publication Data

US 2006/0203476 A1 Sep. 14, 2006

Related U.S. Application Data

(63) Continuation-in-part of application No. 11/016,041, filed on Dec. 16, 2004, now Pat. No. 7,152,995, which is a continuation-in-part of application No. 10/922,813, filed on Aug. 19, 2004, now Pat. No. 7,083,299, which is a continuation-in-part of application No. 10/644,392, filed on Aug. 19, 2003, now abandoned, which is a continuation-in-part of application No. 10/397,766, filed on Mar. 25, 2003, now Pat. No. 7,147,343.

(51) Int. Cl.
*F21L 13/00* (2006.01)

(52) U.S. Cl. ..... 362/205; 362/183

(58) Field of Classification Search ..... 362/183, 362/184, 202, 205, 206
See application file for complete search history.

(56) References Cited

U.S. PATENT DOCUMENTS

| | | | |
|---|---|---|---|
| 1,478,282 | A | 12/1923 | Hunter |
| 1,518,575 | A | 12/1924 | Eaton |
| 1,591,627 | A | 7/1926 | Hopkins |
| 1,595,146 | A | 8/1926 | Ford |
| 1,603,272 | A | 10/1926 | Eaton |
| 2,215,900 | A | 9/1940 | Bitner |
| 2,249,689 | A | 7/1941 | Gelardin |
| 2,313,356 | A | 3/1943 | New |

(Continued)

FOREIGN PATENT DOCUMENTS

| | | |
|---|---|---|
| GB | 2216998 | 10/1989 |

OTHER PUBLICATIONS

Mag-Lite Brochure: Anatomy-Mini Maglite (Jan. 1, 2001).

(Continued)

*Primary Examiner*—Sandra O'Shea
*Assistant Examiner*—James W Cranson
(74) *Attorney, Agent, or Firm*—Kenneth H. Ohriner; Perkins Coie LLP

(57) ABSTRACT

A flashlight includes a first or top section attached to a second or base section. The top section has one or more elements that are axially moveable relative to the base section, for focusing light. This movement may be achieved, for example, by having the top and base sections joined via screw threads, and by rotating one section relative to the other. One or more lenses are supported in the top section. An LED or other light source is supported on the base section. As the sections move relative to each other, the lens moves relative to the LED, focusing light from the LED. The base section has a housing forming a battery compartment for holding at least one battery. Contacts may be provided on the base section for charging the battery, without removing the battery from the flashlight.

9 Claims, 7 Drawing Sheets

U.S. PATENT DOCUMENTS

| | | | | |
|---|---|---|---|---|
| 2,347,532 | A | 4/1944 | Yardeny | |
| 2,435,689 | A | 2/1948 | McCabe | |
| 3,535,282 | A | 10/1970 | Mallory | |
| 3,800,136 | A | 3/1974 | Edelson | |
| 4,546,416 | A | 10/1985 | Pemberton | |
| 4,577,263 | A | 3/1986 | Maglica | |
| 4,605,994 | A | 8/1986 | Krieg | |
| 4,623,957 | A | 11/1986 | Moore et al. | |
| 4,875,147 | A | 10/1989 | Auer | |
| 4,947,291 | A | 8/1990 | McDermott | |
| 5,138,538 | A | 8/1992 | Sperling | |
| 5,351,330 | A | 9/1994 | Jongewaard | |
| 5,422,798 | A | 6/1995 | Osiecki et al. | |
| 5,594,433 | A | 1/1997 | Terlep | |
| 5,630,661 | A | 5/1997 | Fox | |
| 5,816,685 | A * | 10/1998 | Hou | 362/205 |
| 5,838,024 | A | 11/1998 | Masuda et al. | |
| 5,865,529 | A | 2/1999 | Yan | |
| 6,007,218 | A | 12/1999 | German et al. | |
| 6,013,985 | A | 1/2000 | Green et al. | |
| 6,056,415 | A | 5/2000 | Allred, III et al. | |
| 6,086,220 | A | 7/2000 | Lash et al. | |
| 6,095,661 | A | 8/2000 | Lebens et al. | |
| 6,142,650 | A | 11/2000 | Brown et al. | |
| 6,220,719 | B1 | 4/2001 | Vetorino et al. | |
| 6,249,089 | B1 | 6/2001 | Bruwer | |
| 6,296,367 | B1 | 10/2001 | Parsons et al. | |
| 6,345,464 | B1 | 2/2002 | Kim et al. | |
| 6,394,630 | B1 | 5/2002 | Skidmore et al. | |
| 6,398,383 | B1 * | 6/2002 | Huang | 362/202 |
| 6,485,160 | B1 | 11/2002 | Sommers et al. | |
| RE38,014 | E | 3/2003 | Bieberstein | |
| 6,527,419 | B1 | 3/2003 | Galli | |
| 6,536,912 | B2 | 3/2003 | Parker | |
| 6,612,714 | B1 | 9/2003 | Morre et al. | |
| 6,642,667 | B2 | 11/2003 | Avis | |
| 6,712,485 | B2 | 3/2004 | Matthews | |
| 6,736,531 | B2 | 5/2004 | Wallach | |
| 6,761,467 | B2 | 7/2004 | Matthews et al. | |
| 6,767,110 | B2 | 7/2004 | Cooper et al. | |
| 6,793,366 | B2 | 9/2004 | Chun | |
| 6,802,620 | B2 | 10/2004 | Galli | |
| 6,841,941 | B2 | 1/2005 | Kim et al. | |
| 6,854,859 | B2 | 2/2005 | Cooper et al. | |
| 6,866,401 | B2 | 3/2005 | Sommers et al. | |
| 6,957,897 | B1 | 10/2005 | Nelson et al. | |
| 7,104,677 | B2 * | 9/2006 | Barlian et al. | 362/545 |
| 7,147,343 | B2 * | 12/2006 | Chapman | 362/187 |
| 7,323,849 | B1 * | 1/2008 | Robinett et al. | 320/167 |
| 2002/0067608 | A1 | 6/2002 | Kruse | |
| 2002/0093818 | A1 | 7/2002 | Mele | |
| 2003/0123254 | A1 | 7/2003 | Brass et al. | |
| 2003/0133286 | A1 | 7/2003 | Kim | |
| 2004/0130892 | A1 | 7/2004 | Galli | |
| 2004/0140771 | A1 | 7/2004 | Kim et al. | |
| 2004/0240201 | A1 | 12/2004 | Rausseck | |
| 2005/0122714 | A1 | 6/2005 | Matthews et al. | |
| 2005/0157492 | A1 | 7/2005 | Chui | |

OTHER PUBLICATIONS

AV Shop Brochure: LED Flashlight with Magnifier Lens. Web Archive.org (May 25, 2002).

Combined International Search Report and Written Opinion of the International Searching Authority for International Application No. PCT/US2004/08472, dated Sep. 23, 2005.

Combined International Search Report and Written Opinion of the International Searching Authority for International Application No. PCT/US2005/28831, dated Mar. 14, 2006.

* cited by examiner

LED PUSH ROD FLASHLIGHT

PRIORITY CLAIM

This application is a Continuation-in-Part of U.S. patent application Ser. No. 11/016,041, filed Dec. 16, 2004 now U.S. Pat. No. 7,152,995, which is a Continuation-in-Part of U.S. patent application Ser. No. 10/922,813, filed Aug. 19, 2004, now U.S. Pat. No. 7,083,299, which is a Continuation-In-Part of U.S. patent application Ser. No. 10/644,392, filed Aug. 19, 2003, now abandoned, which is a Continuation-In-Part of U.S. patent application Ser. No. 10/397,766, filed Mar. 25, 2003 now U.S. Pat. No. 7,147,343. Priority to each of these applications is claimed under 35 U.S.C. § 120. These applications are also incorporated herein by reference.

A flashlight includes a first or top section attached to a second or base section. The top section has one or more elements that are axially moveable relative to the base section, for focusing light. This movement may be achieved, for example, by having the top and base sections joined via screw threads, and by rotating one section relative to the other. One or more lenses are supported in the top section. An LED or other light source is supported on the base section. As the sections move relative to each other, the lens moves relative to the LED, focusing light from the LED.

The base section has a housing forming a battery compartment for holding at least one battery. Contacts may be provided on the base section for charging the battery, without removing the battery from the flashlight. A push rod may extend through the battery compartment, to actuate a switch in the top section.

Other features and advantages will become apparent from the following detailed description and drawings, which show one embodiment of the flashlight. However, the following detailed description and drawings are intended to describe one example of the flashlight, and they are not intended to describe the only example, or to be limits on the scope of the invention.

DETAILED DESCRIPTION OF THE DRAWINGS

Figure 1:
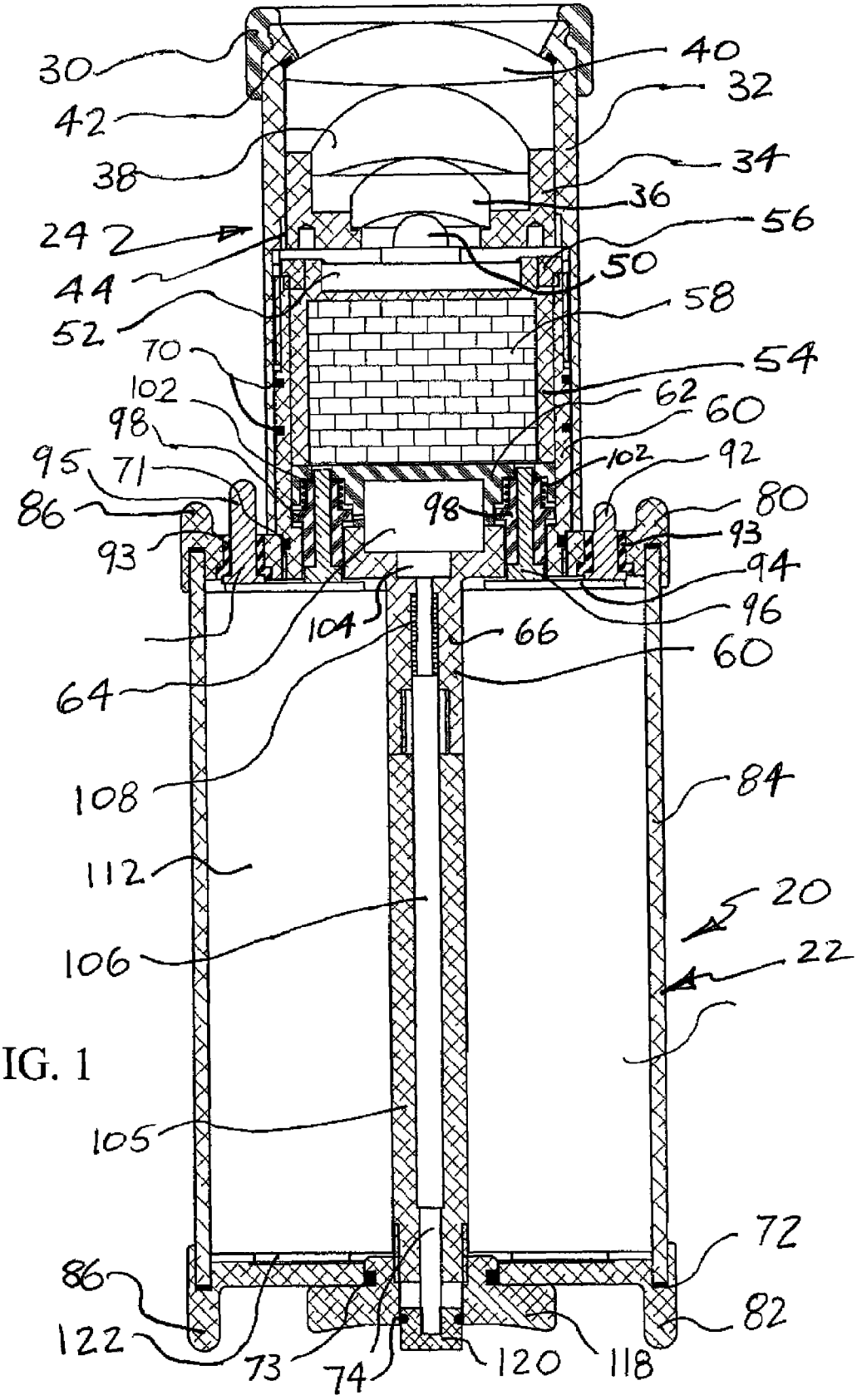
FIG. 1 is a section view of the present flashlight.
Figure 3:
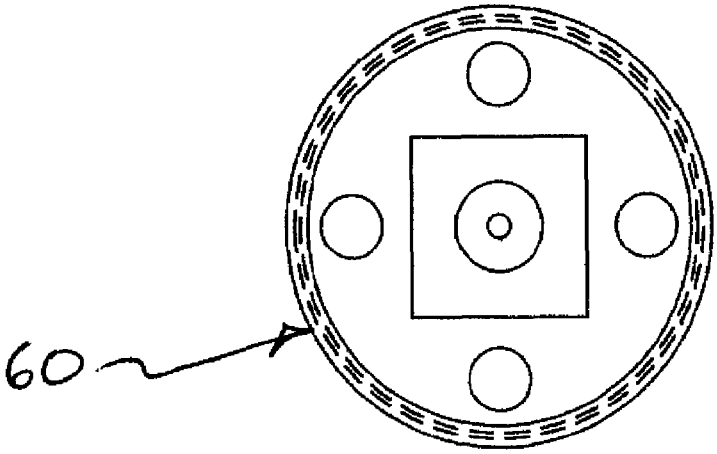
FIG. 3 is a top view.
Figure 2:
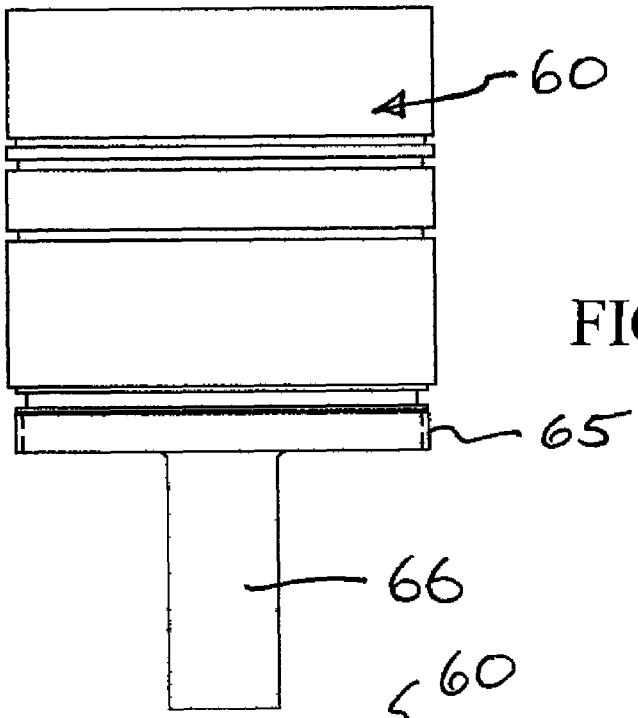
FIG. 2 is a side view of the module cup 60 shown in FIG. 1.
Figure 4:
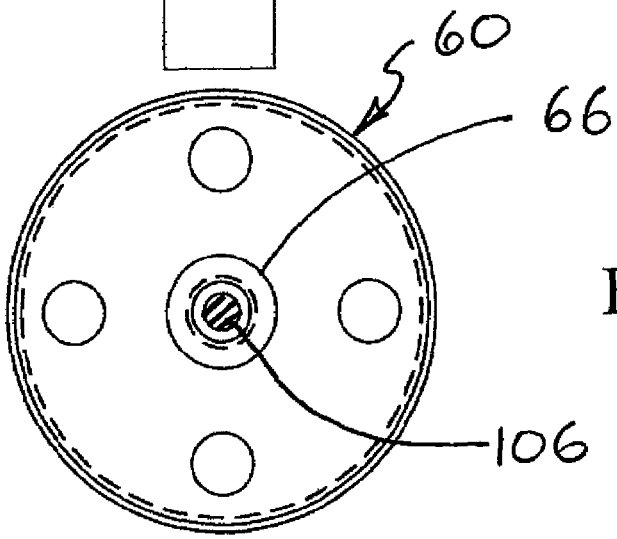
FIG. 4 is a bottom view of the cup shown in FIG. 2.

Turning now to FIG. 1, a flashlight 20 has a body or base section, generally designated 22, and a front or top section, generally designated 24. The top section 24 includes a front cap 30 which can be snapped onto a lens tube 32. One or more lenses may be provided in the flashlight 20. In the design shown, a first lens 36 and a second lens 38 are supported in a lens ring 34 joined to the lens tube via screw threads 44. A third lens 40 is supported near the top or front opening of the lens tube 32. An O-ring 42 seals the perimeter of the lens 40 to the lens tube 32.

A light source, such as an LED 50 is aligned on axis with one or more of lenses 36, 38, and 40, if used. Various types of LEDs may be used. The LED 50 shown in FIG. 1 is a five-watt white LED. The LED 50 may be attached to an LED holder 52, to facilitate making electrical connections and to conduct heat away from the LED 50. A circuit module 58 may be provided within the front section 24. The circuit module 58 may be contained within a circuit module tube 54. The circuit module may include circuitry for regulating current to the LED, or for providing other functions, such as dimming, flashing, stay-bright current regulation, battery charge/time remaining, charging status, etc.

Figure 6:
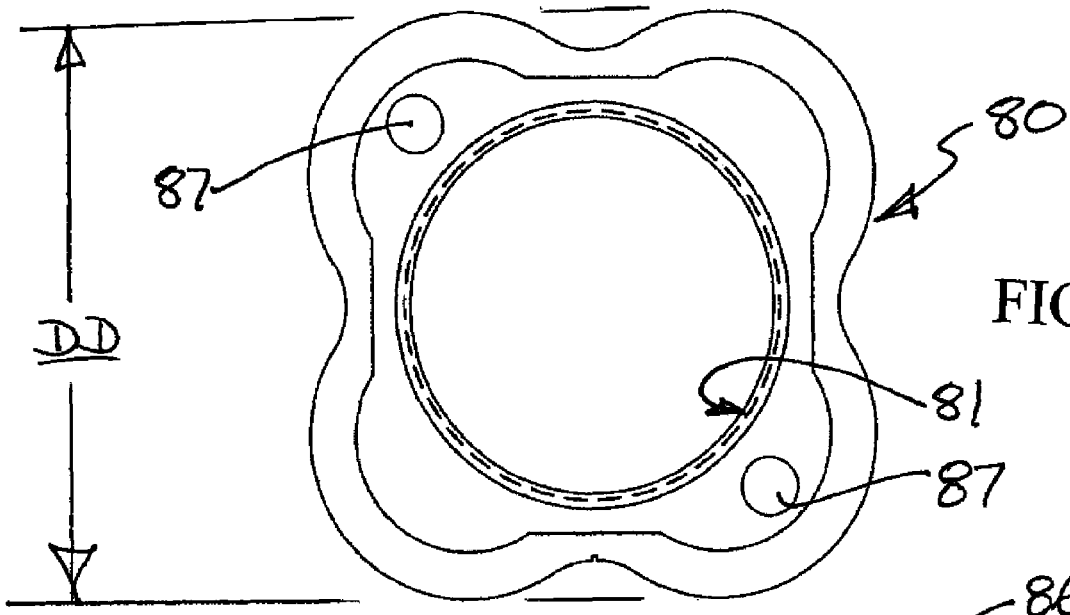
FIG. 6 is a top view.
Figure 5:
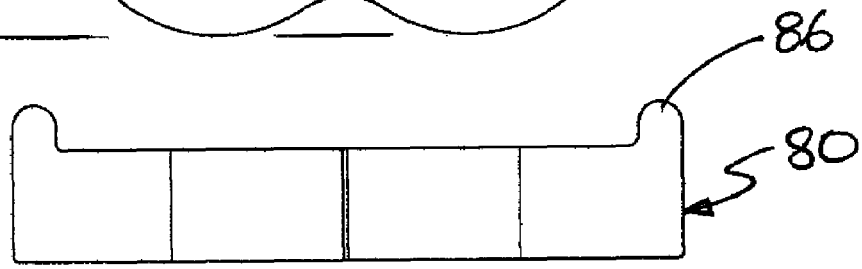
FIG. 5 is a side view of the base cap shown in FIG. 1.
Figure 7:
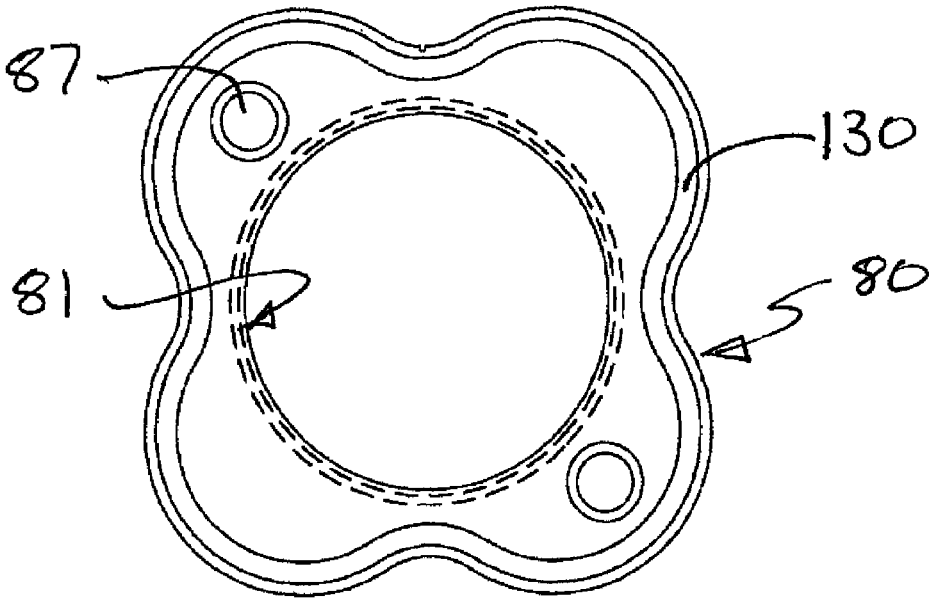
FIG. 7 is a bottom view of the base cap 80 shown in FIG. 5.

Referring now to FIGS. 1-4, a module cup 60 has a cylindrical upper section positioned between the circuit module tube 54 and the lower end of the lens tube 32. A smaller diameter neck 66 of the module cup 60 extends into the base section 22. Screw threads 65 on the module cup 60 engage with corresponding threads 81 on an inside surface of a base cap 80, as shown in FIGS. 5-7. The module cup 60 is accordingly securely attached to the base cap 80. A latching switch 64 is secured between the lower end of the module cup 60 and a switch holder 62. The circuit module 58 and the module tube 54 are clamped down on top of the switch holder 62 via a retainer 56 engaging threads on the inside upper end of the module cup 60.

Referring to FIG. 1, four lithium batteries 112 are connected in series via linking or crossover conducting elements at the top and bottom ends of the battery compartment. A cathode charging pin 92 connects to the cathode contact of the first battery in series and an anode charging pin 95 connects to the anode contact of the last (here the fourth) battery in series. Module contacts 96 are biased downwardly onto these battery contacts as well by springs 102 acting on contact guides 98 surrounding the contacts 96. Battery voltage, in this case 14.4V, is supplied from the batteries 112 to the circuit module 58 via the module contacts 96 and wire leads. Charging pins 92 and 95 are supported on the base cap 80 via pin guides 93. Seals or O-rings 70 and 71 may be used to seal the module cup 60 against the lens tube 32 and against the base cap 80.

Figure 10:
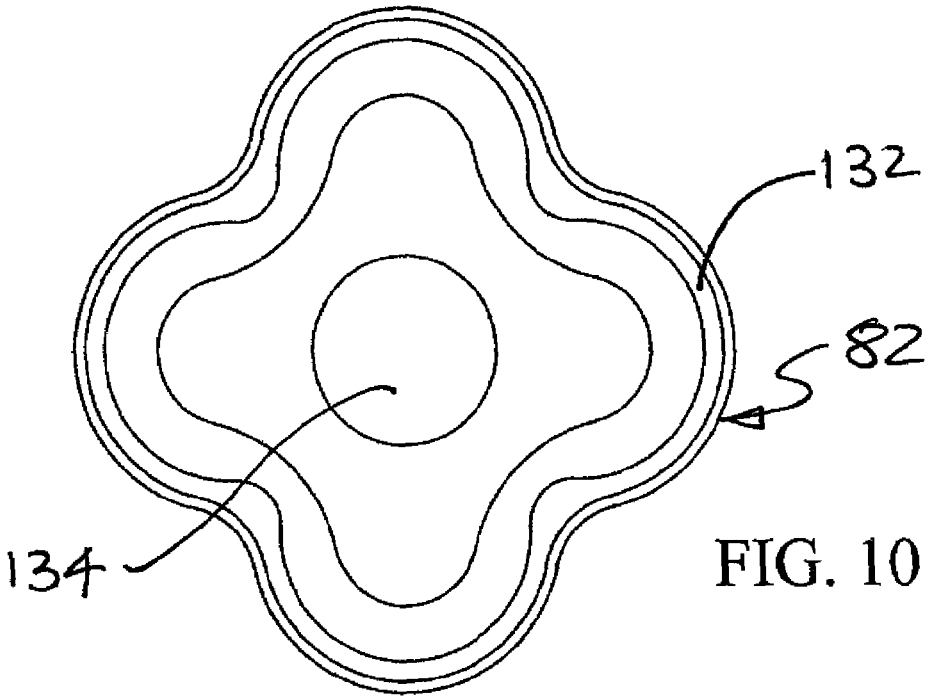
FIG. 10 is a top view of the end cap 82 shown in FIG. 1.
Figure 12:
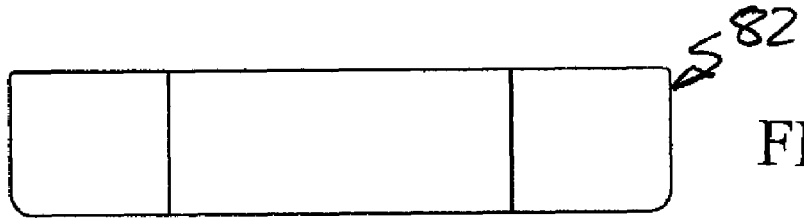
FIG. 12 is a side view, of the end cap shown in FIG. 10.
Figure 11:
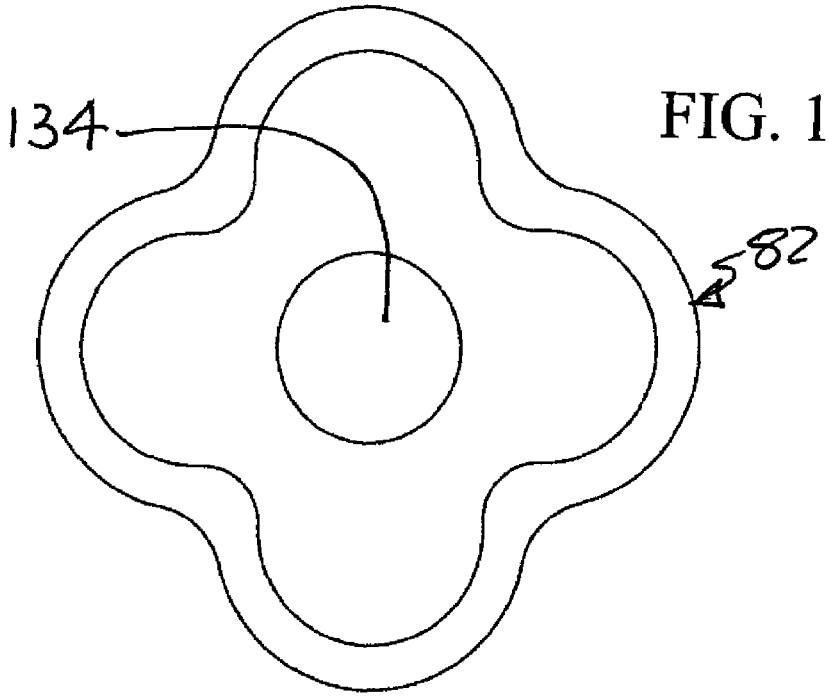
FIG. 11 is a bottom view.
Figure 13:
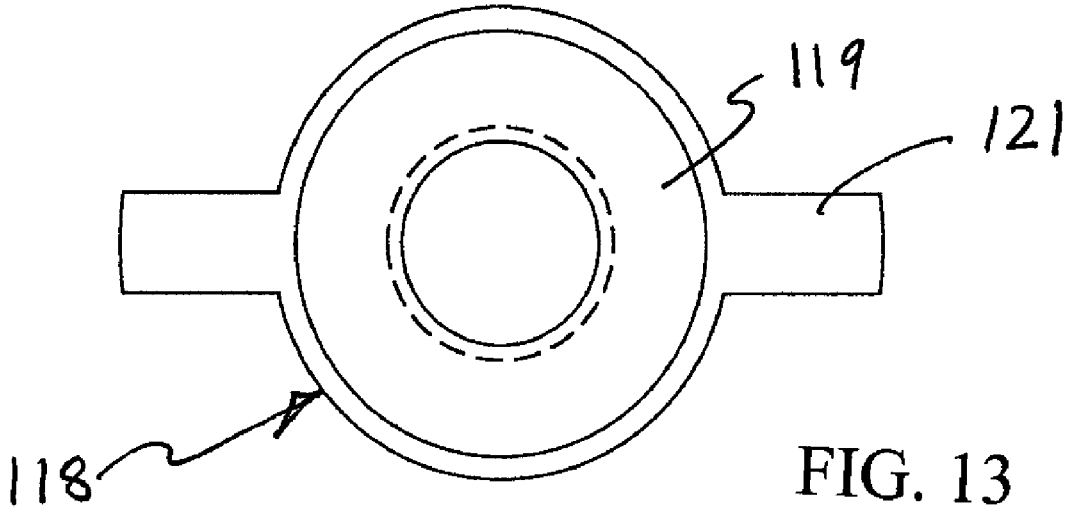
FIG. 13 is a bottom view of the cap nut 118 shown in FIG. 1.
Figure 14:
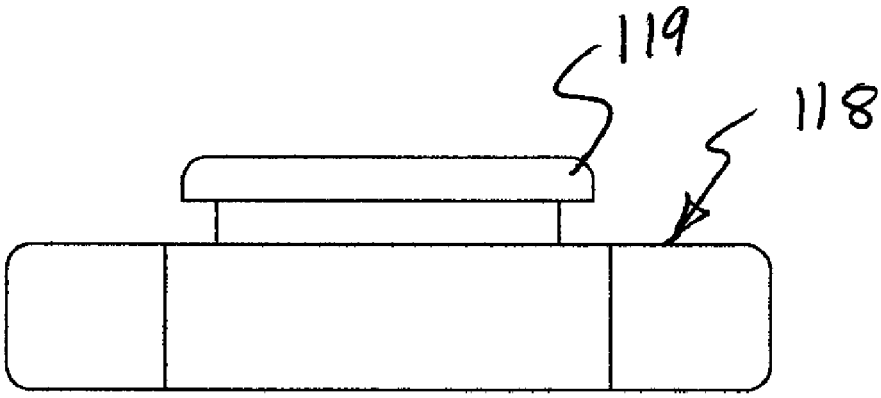
FIG. 14 is a side view of the cap nut 118 shown in FIG. 13.

An end cap 82, as shown in FIGS. 10-12, is attached at the back or bottom end of the base section 22. In the design shown, the base housing 84 is provided as a thin wall metal or plastic shell having multiple lobes 88. The front or top end of the housing 84 is positioned and sealed within a groove 130 in the base cap 80, shown in FIG. 7. Similarly, the lower or bottom end of the base housing 84 is positioned and sealed within a groove 132 in the end cap 82, shown in FIG. 10. An upper or front end of a central standoff 105 is threaded into the neck section 66 of the module cup 60. The standoff 105 extends substantially entirely through the housing 84. A cap nut 118 located within a central opening 134 in the end cap 82 is screwed onto the back or lower end of the standoff 105, thereby clamping the end cap 82 and base cap 80 to the ends of the housing 84.

A push rod 106 extends through a bore in the standoff 105 to engage a plunger 104 of the switch 64. A return spring 108 exerts an outward or downward (return) force on the push rod 106. A counter bore in the standoff 105 limits outward or downward movement of the push rod 106. A push button 120 is attached to the outer or lower end of the push rod 106. An O-ring or seal element 74 seals the push button 120 against the bore in the cap nut 118, while also allowing in/out sliding movement of the push button.

The cap nut 118 may be sealed against the end cap 82 with an O-ring 73. Similarly, O-rings or other seal elements 72 may be provided in the grooves 130 and 132 in the base cap 80 and end cap 82. Adhesives may optionally also be used in addition to, or in place of, sealing elements.

Figure 8:
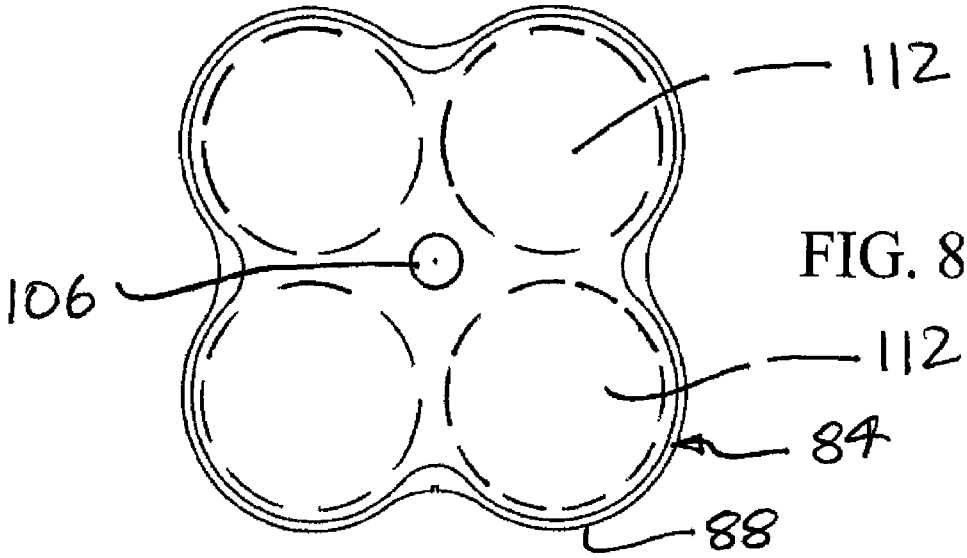
FIG. 8 is a top view of the base housing 84 shown in FIG. 1.
Figure 9:
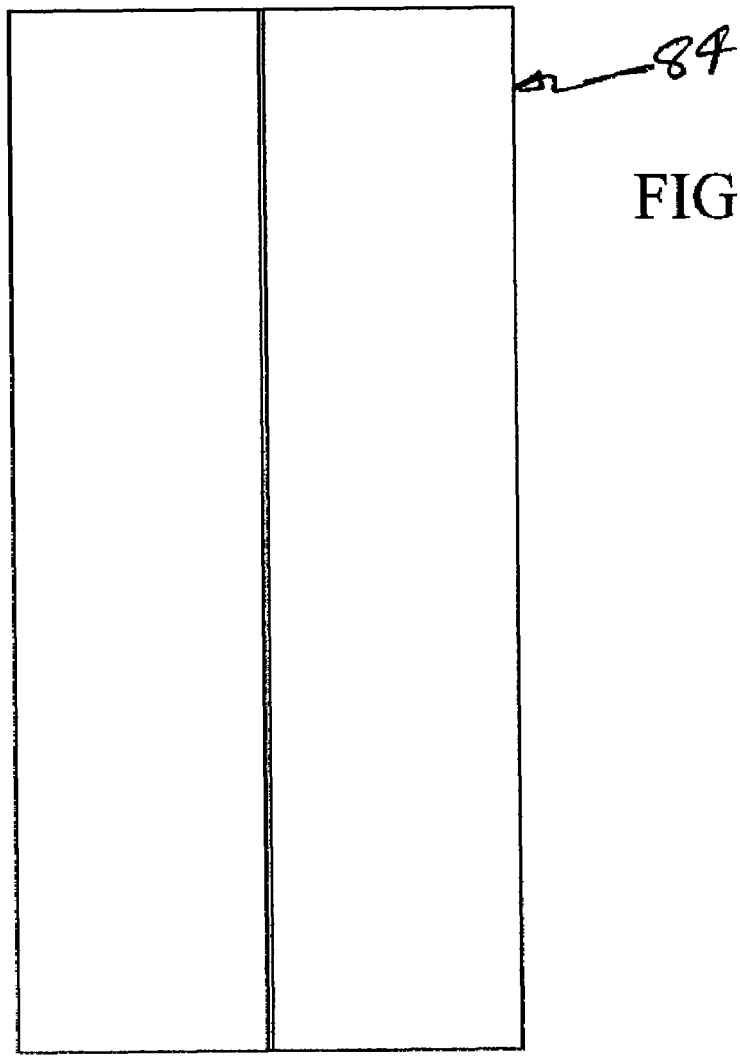
FIG. 9 is a side view of the base housing shown in FIG. 8.

The base cap 80 and end cap 82 may include a raised shoulder 86 projecting outwardly from the base section 22. The raised shoulder 86 helps to resist impact damage to the flashlight 20. Similarly, the front cap 30 on the lens tube 32 helps to prevent the lens and the top section 24 of the flashlight 20 from impact damage. The front cap 30 may be made of a resilient material, such as rubber. As shown in FIG. 1, the front cap 30 may be secured onto the lens tube 32 with a tongue in groove design, allowing the front cap 30 to be quickly and easily installed and removed. The base section has a larger diameter or width than the top section. For example, the lens tube in the design shown has a diameter of about 1¼ inches while the dimension D (referred to here as a diameter, although measured across the flats in FIG. 6) may be about 1½ inches. In this specific design, the flashlight may be about 5¼ inches long. The lobes of the base housing conform to the diameter of the batteries. Accordingly, as shown in FIG. 8, four cylindrical batteries may be contained in a very short and compact space, with very little wasted empty space between them.

In use, the flashlight 20 is advantageously provided with high output and/or long lasting batteries 112, providing up to 8 hours of continuous use. The batteries may be rechargeable lithium batteries 112. The flashlight 20 is turned on by pushing the button 120. This moves the push rod 106 up, depressing the switch plunger 104, and turning the latching switch 64 into an on position. The circuit module includes a DC to DC converter which converts 14.8 battery voltage to about 5 volts for driving the LED. When the switch 64 is closed, the circuit module 58 provides 5 VDC to the LED 50, causing the LED to emit light. Light emitted from the LED 50 is focused by one or more lenses 36, 38, and 40, providing a bright and substantially uniform beam of light. The light may be focused by turning the lens tube 32. As the lens tube 32 turns, it moves axially via the thread engagement between the lens tube 32 and the module cup 60, which is fixed in place on the base section 22. As the lens tube 32 moves axially, the distance between the lens 36 and the LED 50 changes, allowing light from the LED 50 to be focused. The circuit module may optionally also maintain supply of about 5 VDC to the LED, even as battery voltage drops. This allows the flashlight to continue to provide bright light, until the batteries are fully drained. The flashlight is switched off by again pushing the button 120, causing the switch 64 to toggle off.

Heat from the LED 50 is conducted away through the LED holder 52, the module tube 54, the module cup 60, the lens tube 32, and the battery housing 84. These elements may be made of a thermally conductive material, such as aluminum.

The lobes 88 on the base section 22 provide an ergonomic gripping surface for handling the flashlight 20. The flashlight is compact and relatively short, with a low center of gravity. This makes the flashlight stable. For example, the flashlight may be set on its base, i.e., on end plate 82 or on its side, and it will generally remain in place. When used in an upright position, a lampshade/diffuser accessory may be attached to the top end, allowing the flashlight to act as a table lamp.

The base cap 80 and the end cap 82, as well as the base housing 84, may be made of metal, e.g., aluminum formed via die casting or other process, or alternatively of a high strength plastic, to better resist impact and rough handling. The base housing 84, for example, may be formed from an aluminum extrusion. A rubber sleeve accessory may be fit over the base housing 84 to protect the base section from impact, abrasion, etc. The rubber sleeve may have through holes for better heat dissipation.

The seals or O-rings 42 and 70-73 provide a substantially water proof enclosure. Accordingly, the flashlight 20 may be used in wet conditions, or even submerged, while continuing to operate. The pin guides 93 seal around the charging pins 92 and 95.

Figure 15:
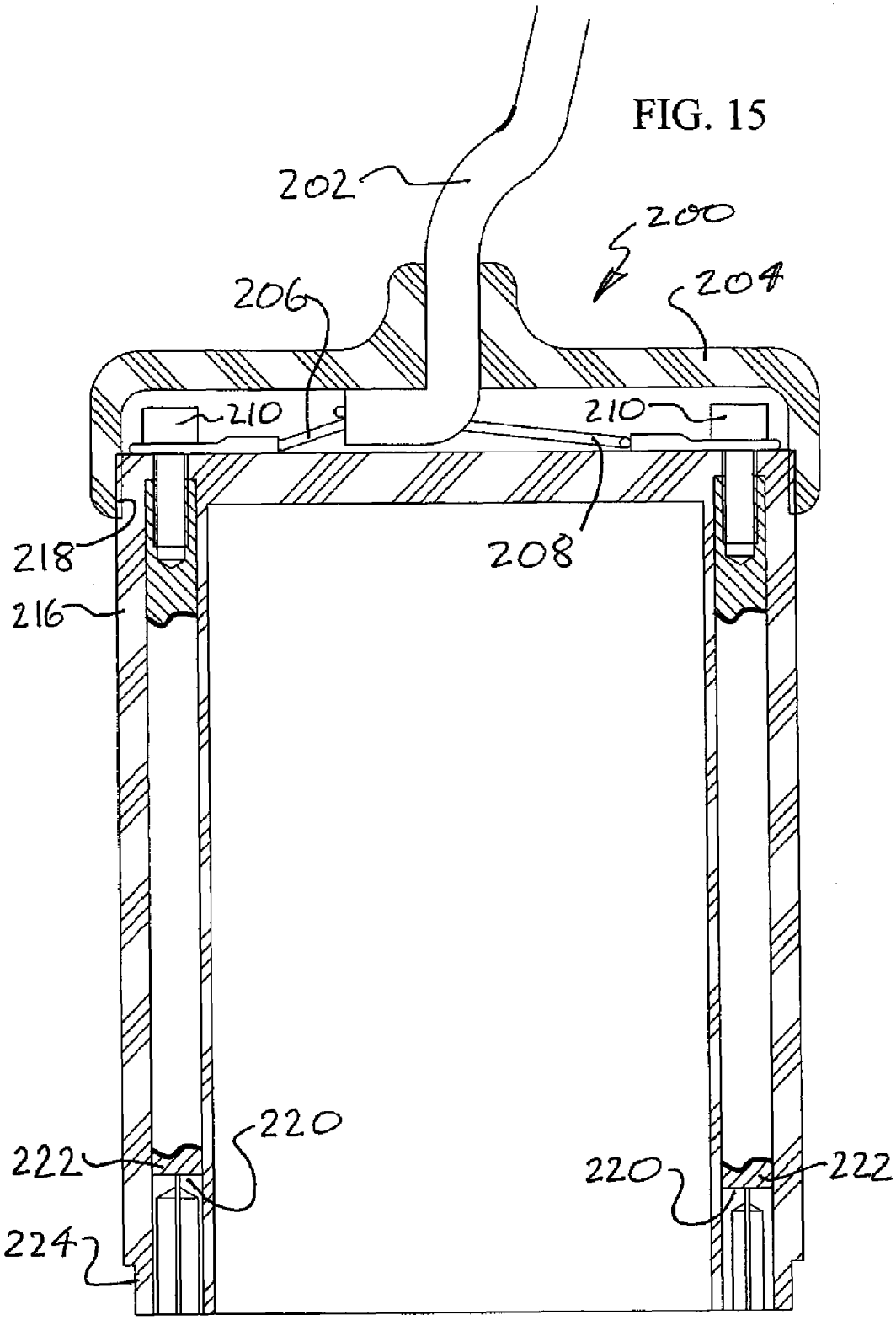
FIG. 15 is a section view of a battery charger for use with the flashlight shown in FIG. 1.

The batteries 112 may be charged without removing them from the flashlight 20. Referring to FIG. 15, a charger 200 is adapted to make electrical contact with the charging pins 92 and 95, to charge the batteries 112.

The charger 200 includes a power lead 202 attached to contact points 222 positioned within contact bores 220 in the cylindrical sidewalls of the charger housing 216. Wire leads 206 and 208 from the power wire 202 are attached to the contact pins 222 via cap screws 210. A top cap 204 is threaded onto the upper end of the charger housing 216. The power line 202 connects to a battery charger which provides for rapid charging of the batteries 112, as is well known in the field. Since the battery charger can operate off of wall current, or from e.g., a 12 volt vehicle battery, the flashlight may be charged from various sources.

To charge the batteries 112, without removing them from the flashlight 20, the front cap 30 is removed from the front section 24 of the flashlight 20. The charger housing 216 is moved down over the front section 24, with the contact pins 222 of the charger 200 making physical and electrical contact with the charging pins 92 and 95. The contact pins 222 have split lower ends that slide over and onto the charging pins 92 and 95. The charging pin 95 is larger and longer than the charging pin 92, to prevent connecting the charger 200 with reverse polarity. A shoulder 224 at the bottom end of the charger housing 216 comes to a stop against the shoulder ring 86 on the base cap 80. Current flows through the charger 200, charging pins 92 and 95, to the batteries 112, so that the batteries are charged. Upon completion of charging, the charger 200 is removed by pulling it off of the flashlight 20. The flashlight 20 is then ready for renewed use. The charging pin 92 is shielded by the raised shoulder 86 of the base cap 80, to better avoid inadvertent contact with the charging pin 92.

To change the batteries 112, the cap nut 118 is unscrewed from the standoff 105 and removed. This opens up the bottom end of the base housing 84, allowing the batteries to be removed and replaced. The flashlight 20 may be used with standard (disposable) batteries, or with rechargeable batteries. When rechargeable batteries are used, replacing the batteries will seldom be needed. When non-rechargeable batteries are used, they may be quickly and easily replaced by unscrewing the cap nut 118 and removing the end cap 82. After the batteries are replaced, the end cap 82 is once again secured to the housing 84 via the cap nut 118, and the battery compartment is again sealed by the seal element for O-ring 72 contained in the groove in the end cap 82.

Various changes and substitutions may of course be made without departing from the spirit and scope of the invention. The invention, therefore, should not be limited, except to the following claims and their equivalents.

The invention claimed is:

1. A flashlight comprising:

a top section joined to a base section;

with the top section having a lens tube attached to the module cup on the base section via screw threads;

a lens ring within the lens tube;

at least one lens in the lens ring;

an LED in the top section and supported directly or indirectly on the base section, with a spacing between the LED and the lens adjustable to focus light from the LED, by turning the lens tube relative to the base section;

a switch on the base section;

a base section housing forming a battery compartment in the base section holding at least one battery; and a push rod extending from a back end of the base section, through the base housing and contacting a plunger on the switch.

2. The flashlight of claim 1 with the base section having a base cap attached to a first end of the base section housing and an end cap attached at a second end of the base section housing, and with the base and end caps each having a projecting annular shoulder ring.

3. The flashlight of claim 2 further comprising first and second battery charging pin contacts extending through the base case and connecting to a contact plate in the battery compartment.

4. The flashlight of claim 2 with the push rod extending through a standoff, and with a cap nut threaded onto the standoff and clamping the end cap onto the second end of the base section housing.

5. The flashlight of claim 3 further comprising a battery charger adapted to fit over the top section, and connect with the first and second battery charging pins, for charging the batteries.

6. The flashlight of claim 4 with the base section having four lobes and with the push rod centered between the lobes.

7. A flashlight comprising:

a base section;

a top section joined to the base section via screw threads;

an LED supported by the base section;

at least one lens in the top section;

with a spacing between the LED and the lens adjustable to focus light from the LED, by turning the top section relative to the base section;

a switch in the top section;

a base section housing forming a battery compartment in the base section holding at least one battery; and a push rod extending the battery compartment to the switch.

8. A flashlight comprising:

a first section having a first diameter;

a second section having a second diameter larger than the first diameter, with the second section axially moveable relative to the first section;

a light source on the second section;

at least one lens on the first section in alignment with the light source;

a battery compartment in the second section; and first and second battery charging pin contacts on the second section extending into the battery compartment.

9. The flashlight of claim 8 with the first charging pin contact larger than the second battery pin contact.

* * * * *